US007733314B2

(12) United States Patent
Cho

(10) Patent No.: US 7,733,314 B2
(45) Date of Patent: Jun. 8, 2010

(54) DISPLAY DEVICE

(75) Inventor: Hyun-Sang Cho, Cheonan-si (KR)

(73) Assignee: Samsung Electronics Co., Ltd. (KR)

( * ) Notice: Subject to any disclaimer, the term of this patent is extended or adjusted under 35 U.S.C. 154(b) by 865 days.

(21) Appl. No.: 11/544,085

(22) Filed: Oct. 6, 2006

(65) Prior Publication Data

US 2007/0195047 A1 Aug. 23, 2007

(30) Foreign Application Priority Data

Feb. 21, 2006 (KR) ..... 10-2006-0016804

(51) Int. Cl.
*G09G 3/36* (2006.01)

(52) U.S. Cl. ..... 345/89; 345/690

(58) Field of Classification Search ..... 345/87–102, 345/204–210, 690–699
See application file for complete search history.

(56) References Cited

U.S. PATENT DOCUMENTS

2003/0122761 A1* 7/2003 Hong ..... 345/89
2004/0196274 A1* 10/2004 Song et al. ..... 345/204
2005/0093803 A1* 5/2005 Cheon et al. ..... 345/92
2006/0176264 A1* 8/2006 Go ..... 345/100
2007/0070015 A1* 3/2007 Chang et al. ..... 345/94

* cited by examiner

*Primary Examiner*—Amr Awad
*Assistant Examiner*—Stephen G Sherman
(74) *Attorney, Agent, or Firm*—Cantor Colburn LLP

(57) ABSTRACT

In a display device, a first image processor outputs a first pretilt gray scale in response to a first external image signal during a first pretilt period and a second image processor outputs a second pretilt gray scale higher than the first pretilt gray scale in response to a second external image signal during a second pretilt period. A gamma reference voltage generator outputs a gamma reference voltage. A data driver outputs a first pretilt voltage by converting the first pretilt gray scale into the first pretilt voltage and outputs a second pretilt voltage identical to the first pretilt voltage by converting the second pretilt gray scale into the second pretilt voltage.

20 Claims, 7 Drawing Sheets

DISPLAY DEVICE

This application claims priority to Korean Patent Application No. 2006-16804 filed on Feb. 21, 2006, and all the benefits accruing therefrom under 35 U.S.C. §119, the contents of which are herein incorporated by reference in its entirety.

BACKGROUND OF THE INVENTION

1. Field of the Invention

The present invention relates to a display device. More particularly, the present invention relates to a display device capable of improving quality of images displayed on the display device.

2. Description of the Related Art

In general, a liquid crystal display device includes two display substrates and a liquid crystal layer interposed between both substrates. In such a liquid crystal display device, an electric field is applied to a liquid crystal layer and intensity of the electric field is controlled so as to adjust the transmittance of light passing through the liquid crystal layer, thereby displaying desired images.

As liquid crystal display devices have been widely used for display screens of televisions as well as computers, realization of video images in the liquid crystal display devices has been required increasingly. However, since conventional liquid crystal display devices have a low response speed of liquid crystals, such video images may not be effectively realized in the liquid crystal display devices.

In detail, since liquid crystal molecules have a low response speed, a certain period of time is necessary to charge a liquid crystal capacitor with a target voltage (i.e. a voltage at which a desired luminance can be obtained). Such time delay depends on the potential difference between the target voltage and the previous voltage, which has already been charged in the liquid crystal capacitor in the previous frame.

Particularly, if the potential difference between the target voltage and the previous voltage is great, application of the target voltage from the starting point may inhibit the liquid crystal capacitor from reaching the target voltage within a period of 1H during which a switching element is maintained in a turn-on state.

BRIEF SUMMARY OF THE INVENTION

An exemplary embodiment provides a display device capable of improving a response speed of liquid crystal.

In an exemplary embodiment, a display device includes a first image processor, a second image processor, a gamma reference voltage generator, a data driver, a gate driver and a display unit.

The first image processor outputs a first pretilt gray scale in response to a first external image signal during a first pretilt period and the second image processor outputs a second pretilt gray scale higher than the first pretilt gray scale in response to a second external image signal during a second pretilt period.

The gamma reference voltage generator receives a power supply voltage from an exterior in order to output a gamma reference voltage. The data driver converts the first pretilt gray scale into a first pretilt voltage based on the gamma reference voltage and outputs the first pretilt gray scale during the first pretilt period, and converts the second pretilt gray scale into a second pretilt voltage, which is identical to the first pretilt voltage, based on the gamma reference voltage and outputs the second pretilt gray scale during the second pretilt period. The gate driver outputs a first gate signal during the first pretilt period and outputting a second gate signal during the second pretilt period.

The display unit displays images and uses a plurality of pixels including first and second pixels. The first pixels receive the first pretilt voltage in response to the first gate signal during the first pretilt period and the second pixels receive the second pretilt voltage in response to the second gate signal during the second pretilt period.

In an exemplary embodiment, a display device includes an image processor, a gamma reference voltage generator, a data driver, a gate driver and a display unit.

The image processor outputs a first pretilt signal during a first pretilt period and a second pretilt signal during a second pretilt period in response to external image signals, the first pretilt signal corresponding to a first gray scale and the second pretilt signal corresponding to a second gray scale higher than the first gray scale. The gamma reference voltage generator receives a power supply voltage from an exterior and outputs first and second gamma reference voltages.

The data driver converts the first pretilt signal into a first pretilt voltage based on the first gamma reference voltage and outputs the first pretilt voltage during the first pretilt period, and converts the second pretilt signal into a second pretilt voltage, which is identical to the first pretilt voltage, based on the second gamma reference voltage and outputs the second pretilt voltage during the second pretilt period. The gate driver outputs a first gate signal during the first pretilt period and outputs a second gate signal during the second pretilt period.

The display unit displays images and uses a plurality of pixels including first and second pixels. The first pixels receive the first pretilt voltage in response to the first gate signal during the first pretilt period and the second pixels receive the second pretilt voltage in response to the second gate signal during the second pretilt period.

In an exemplary embodiments, first and second pretilt voltages having the same level are applied to the liquid crystal in the first and second periods during which the first and second pixels are pretilted, respectively. Thus, the liquid crystal can be charged with the same voltage during the first and second periods, such that the response speed of the liquid crystal may not be lowered.

BRIEF DESCRIPTION OF THE DRAWINGS

The above and other advantages of the present invention will become readily apparent by reference to the following detailed description when considered in conjunction with the accompanying drawings wherein.

DETAILED DESCRIPTION OF THE INVENTION

Figure 1:
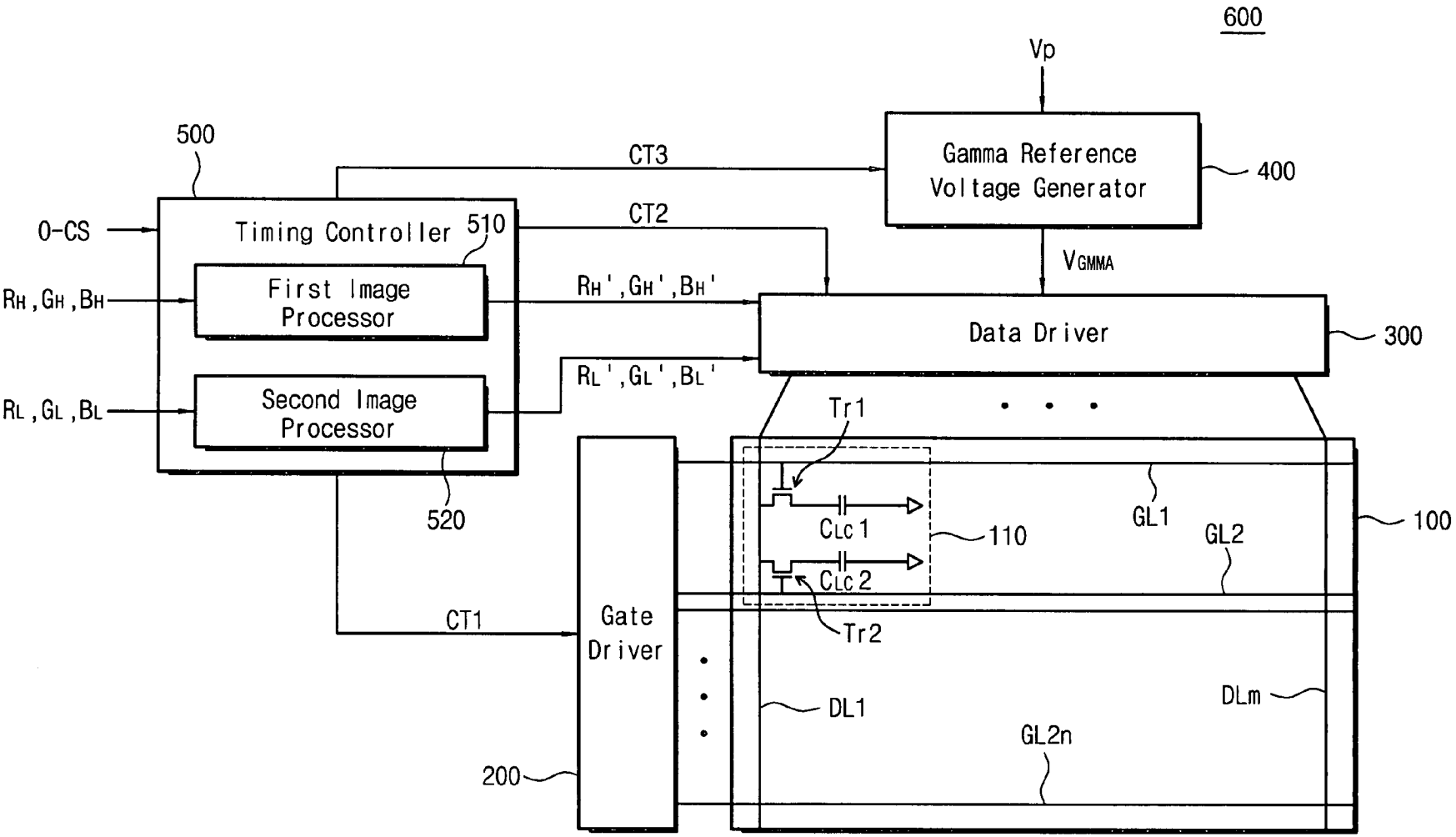
FIG. 1 is a block diagram showing an exemplary embodiment of a liquid crystal display device according to the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. Like numbers refer to like elements throughout. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be explained in detail with reference to the accompanying drawings. FIG. 1 is a block diagram showing an exemplary embodiment of a liquid crystal display device according to the present invention.

Referring to FIG. 1, a liquid crystal display device 600 includes a display unit 100, a gate driver 200, a data driver 300, a gamma reference voltage generator 400 and a timing controller 500.

The display unit 100 is provided with a plurality of gate lines GL1 to GL2*n* receiving the gate voltage and a plurality of data lines DL1 to DLm receiving the data voltage. The gate lines GL1 to GL2*n* and the data lines DL1 to DLm are aligned on the display unit 100 substantially in a matrix pattern and define a plurality of pixel areas. Pixels 110, each including a main pixel and a sub pixel, are provided in the pixel areas. The main pixel includes a first thin film transistor Tr1 and a first liquid crystal capacitor $C_{LC1}$ and the sub pixel includes a second thin film transistor Tr2 and a second liquid crystal capacitor $C_{LC2}$.

The gate driver 200 is electrically connected to the gate lines GL1 to GL2*n* provided in the display unit 100 so as to apply gate signals to the gate lines GL1 to GL2*n*. The data driver 300 is electrically connected to the data lines DL1 to DLm provided in the display unit 100 in order to apply a high gamma voltage or a low gamma voltage to the data lines DL1 to DLm.

The timing controller 500 receives first external image signals $R_H$, $G_H$ and $B_H$, second external image signals $R_L$, $G_L$ and $B_L$, and various control signals O-CS from an external graphic controller (not shown). The timing controller 500 compensates first external image signals $R_H$, $G_H$ and $B_H$ through the first image processor 510, thereby outputting high compensated signals $R'_H$, $G'_H$ and $B'_H$. The timing controller 500 compensates second external image signals $R_L$, $G_L$ and $B_L$ through the second image processor 520, thereby outputting low compensated signals $R'_L$, $G'_L$ and $B'_L$. In exemplary embodiments, the timing controller 500 receives various control signals O-CS including, but not limited to, a vertical synchronous signal, a horizontal synchronous signal, a main clock signal, a data enable signal, etc., in order to output first, second and third control signals CT1, CT2 and CT3, respectively.

The first control signal CT1 is transmitted to the gate driver 200 to control the operation of the gate driver 200. The first control signal CT1 may include a vertical start signal used to start the operation of the gate driver 200, a gate clock signal used to determine an output time of the gate voltage and an output enable signal used to determine on-pulse width of the gate voltage.

The gate driver 200 sequentially outputs the gate signals to the gate lines GL1 to GL2*n* in response to the first control signal CT1 from the timing controller 500.

The second control signal CT2 is transmitted to the data driver 300 to control the operation of the data driver 300. The second control signal CT2 may include a horizontal start signal used to start the operation of the data driver 300, an inversion signal used to inverse polarity of the data voltage and an output command signal used to determine an output time of the high or low gamma signal of the data driver 300.

The data driver 300 sequentially receives the high compensated signals $R'_H$, $G'_H$ and $B'_H$ and low compensated signals $R'_L$, $G'_L$ and $B'_L$, which correspond to pixels of one row, in response to the second control signal CT2 of the timing controller 500.

The gamma reference voltage generator 400 receives a power supply voltage Vp from an exterior and then generates a gamma reference voltage $V_{GMMA}$ in response to the third control signal CT3 from the timing controller 500. The data driver 300 converts the high compensated signals $R'_H$, $G'_H$ and $B'_H$ into high gamma voltages based on the gamma reference voltage $V_{GMMA}$ from the gamma reference voltage generator 400 in order to output the high gamma voltages in a first period during which the main pixels are driven. In addition, data driver 300 converts the low compensated signals $R'_L$, $G'_L$ and $B'_L$ into low gamma voltages based on the gamma reference voltage $V_{GMMA}$ from the gamma reference voltage generator 400 in order to output the low gamma voltages in a second period during which the sub pixels are driven. Here, the high gamma voltage has a level higher than that of the low gamma voltage.

Figure 2:
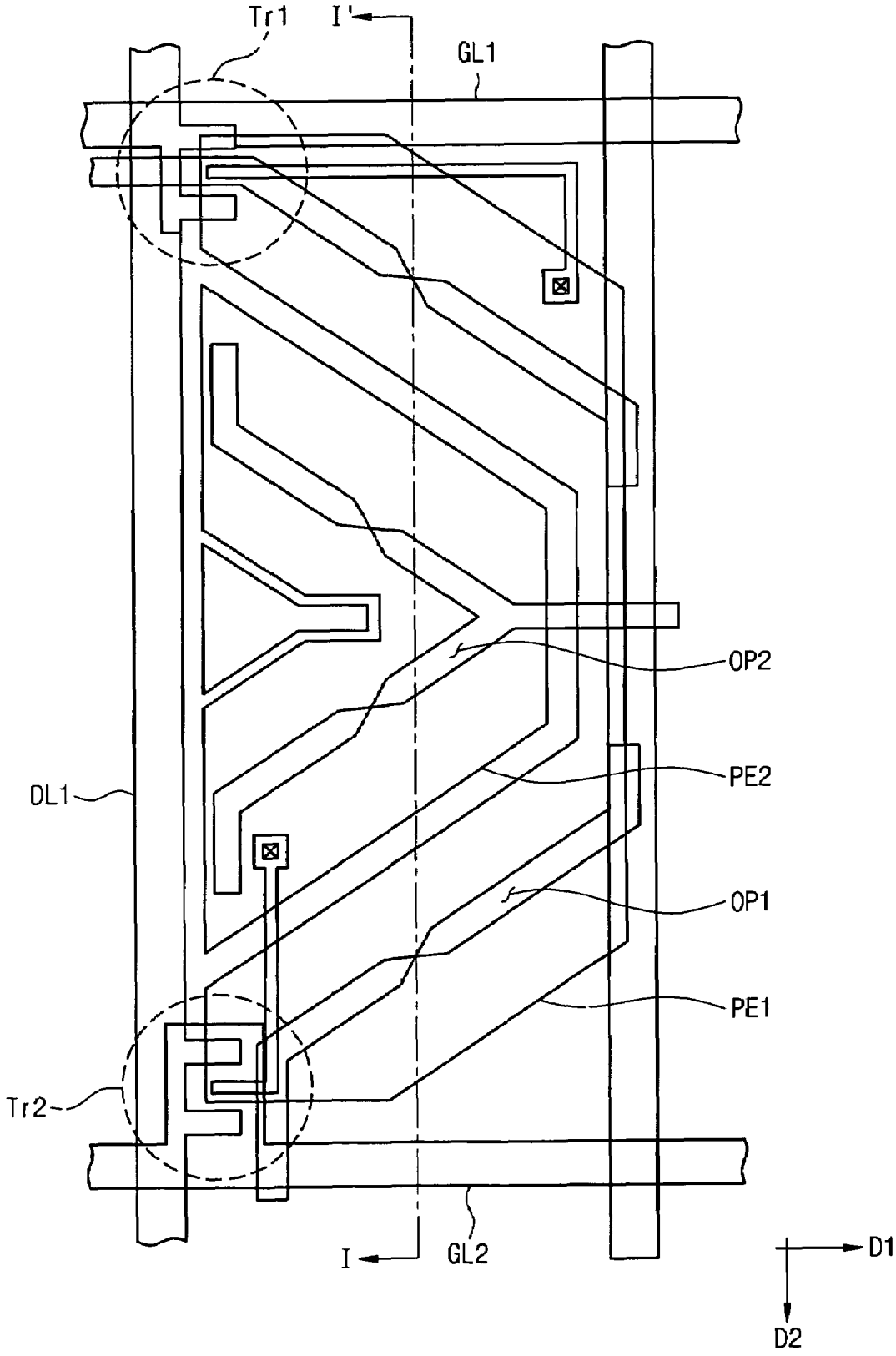
FIG. 2 is a layout view showing an exemplary embodiment of a pixel in a display unit shown in FIG. 1.
Figure 3:
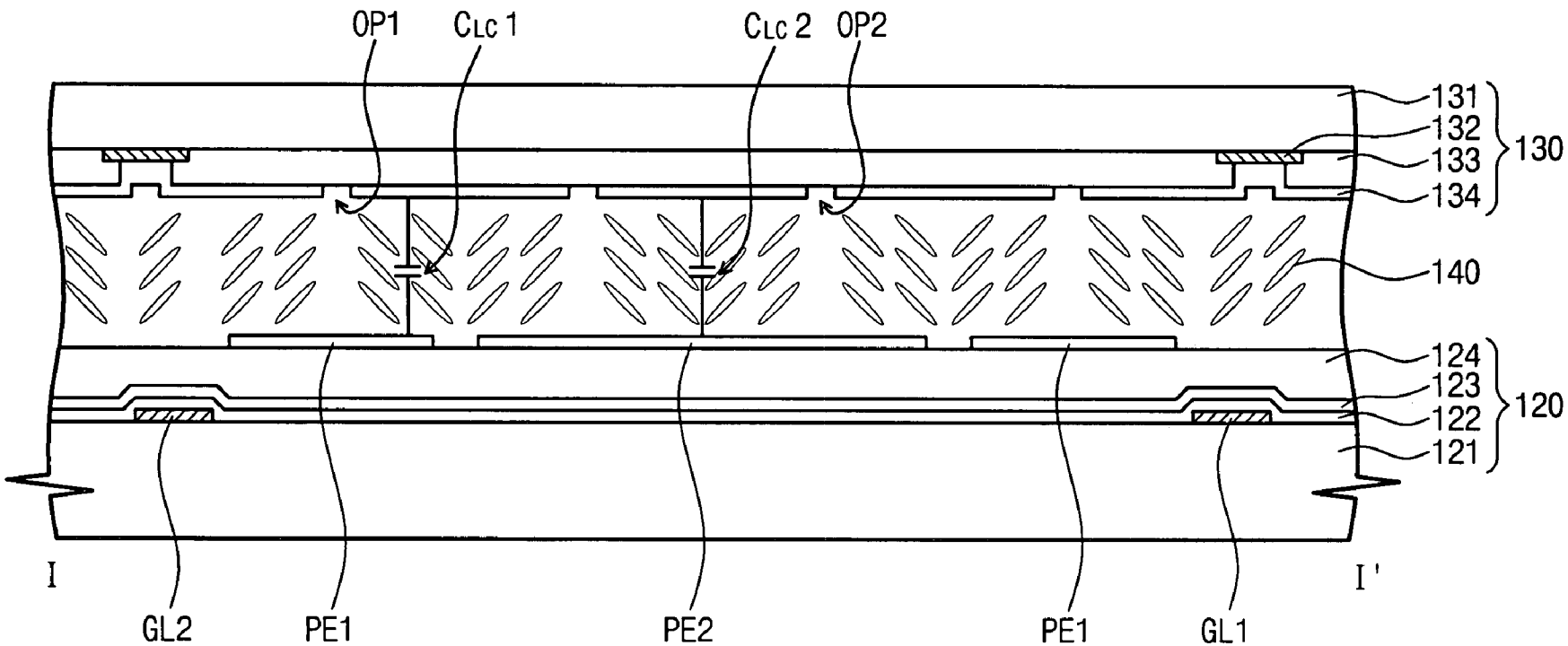
FIG. 3 is a cross-sectional view taken along line I-I' shown in FIG. 2.

FIG. 2 is a layout view showing an exemplary embodiment of a pixel in the display unit shown in FIG. 1 and FIG. 3 is a cross-sectional view taken along line I-I' shown in FIG. 2.

Referring to FIGS. 2 and 3, the display unit 100 (see, FIG. 1) is prepared in the form of a liquid crystal display panel including an array substrate 120, a color filter substrate 130 facing the array substrate 120 and a liquid crystal layer 140 interposed between the array substrate 120 and the color filter substrate 130.

Pixel areas are defined on a first base substrate 121 of the array substrate 120 by first and second gate lines GL1 and GL2 extending in a first direction D1 and first data lines DL1 extending in a second direction D2 substantially perpendicular to the first direction D1.

Pixels each having the sub pixel and the main pixel are formed in the pixel areas, respectively. In particular, in the array substrate 120, the main pixel includes a first thin film transistor Tr1 and a first pixel electrode PE1, which is a first electrode of a first liquid crystal capacitor CLC1. The sub pixel includes a second thin film transistor Tr2 and a second pixel electrode PE2, which is a first electrode of a second liquid crystal capacitor $C_{LC2}$.

A gate electrode of the first thin film transistor Tr1 branches from the first gate line GL1 and a gate electrode of the second thin film transistor Tr2 branches from the second gate line GL2. Source electrodes of the first and second thin film transistors Tr1 and Tr2 branch from the first data line DL1. A drain electrode of the first thin film transistor Tr1 is connected to the first pixel electrode PE1 and a drain electrode of the second thin film transistor Tr2 is electrically connected to the second pixel electrode PE2.

As shown in the exemplary embodiment of FIG. 3, the array substrate 120 may further include a gate insulating layer 122, a protective layer 123 and/or an organic insulating layer 124 provided below the first and second pixel electrodes PE1 and PE2 and cover the first and second gate lines GL1 and GL2.

The color filter substrate 130 includes a second base substrate 131 on which a black matrix 132, a color filter layer 133 and a common electrode 134 are formed. The black matrix 132 is formed in a non-effective display area, where the first and second gate lines GL1 and GL2 are formed, in order to reduce or effectively prevent leakage of light. The color filter layer 133 may include red, green and/or blue color pixels so as to allow the light that has passed through the liquid crystal layer 140 to have a predetermined color.

The common electrode 134 is formed on the color filter layer 133 as a second electrode of the first and second liquid crystal capacitors $C_{LC1}$ and $C_{LC2}$. Predetermined portions of the common electrode 134, which correspond to substantially center portions of the first and second pixel electrodes PE1 and PE2, are partially removed. These removed portions form first openings OP1 corresponding to the center portions of the first pixel electrodes PE1 and a second opening OP2 corresponding to the center portion of the second pixel electrode PE2. As a result, eight domains are formed in each of the pixel areas in such a manner that liquid crystal molecules included in the liquid crystal layer 140 can be aligned in different directions.

Figure 4:
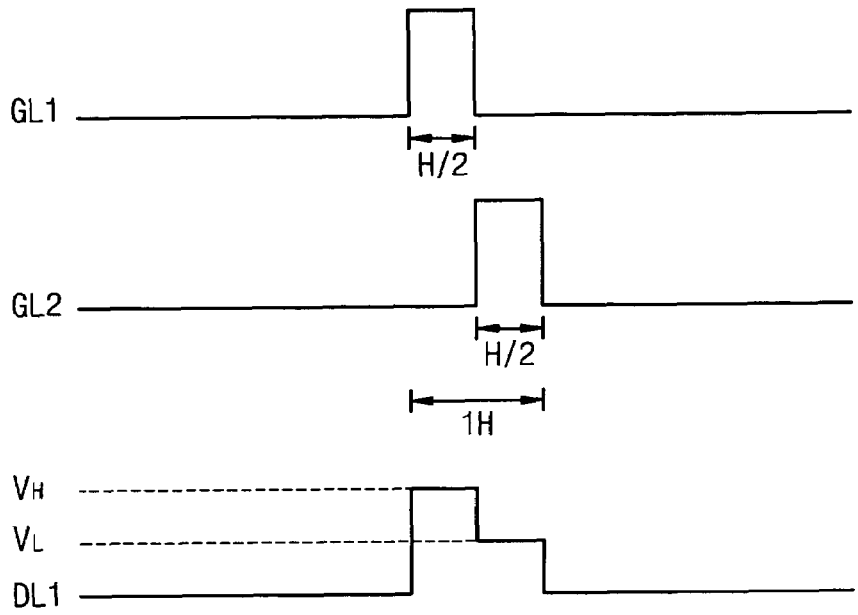
FIG. 4 is a waveform diagram of an exemplary embodiment of signals applied to a first data line, and first and second gate lines shown in FIG. 2.
Figure 5:
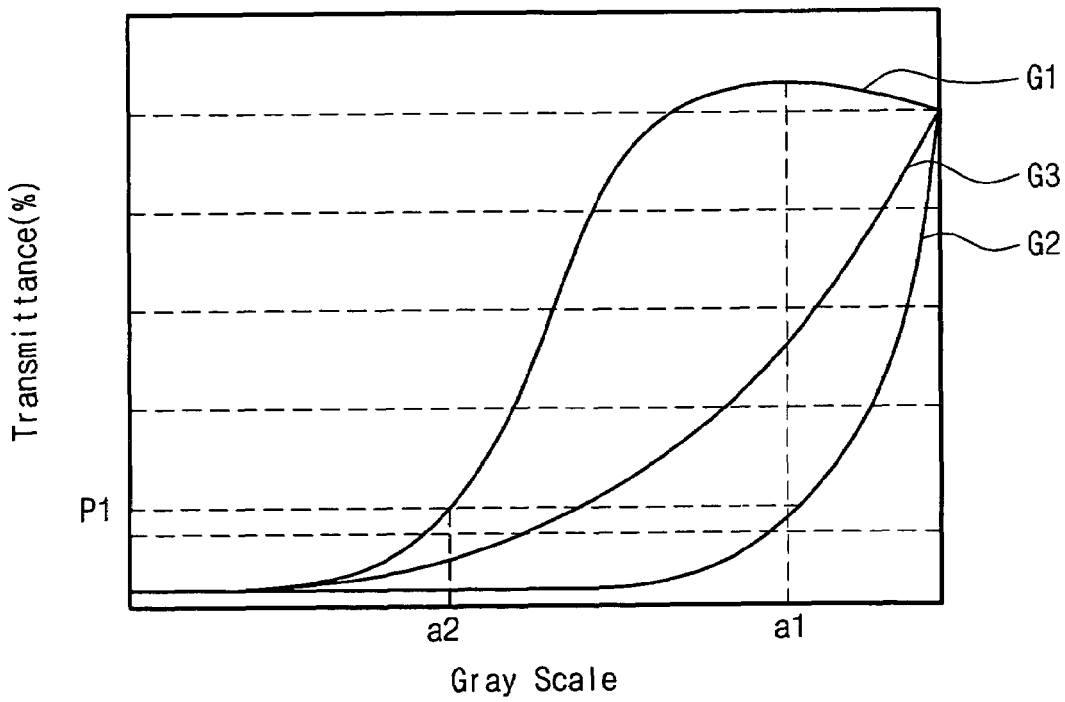
FIG. 5 is a graph showing an exemplary embodiment of transmittance of main and sub pixels according to gray scales.

FIG. 4 is a waveforms diagram of an exemplary embodiment of signals applied to the first data line and the first and second gate lines shown in FIG. 2 and FIG. 5 is a graph showing an exemplary embodiment of transmittance of main and sub pixels according to gray scales. In FIG. 5, an x-axis represents a gray scale and a y-axis represents transmittance (%).

Referring to FIG. 4, assuming that one pixel is driven for 1H (e.g., within one frame period), the first gate signal maintaining the high state for an earlier H/2 during which the main pixel is driven, is applied to the first gate line GL1. In addition, the second gate signal maintaining the high state for a later H/2 during which the sub pixel is driven, is applied to the second gate line GL2.

The first thin film transistor Tr1 transfers the high gamma voltage $V_H$ applied to the first data line DL1 to the first pixel electrode PE1 (see, FIG. 2) in response to the first gate signal. After that, the second thin film transistor Tr2 transfers the low gamma voltage $V_L$, which is applied to the first data line DL1 and has a level lower than that of the high gamma voltage $V_H$, to the second pixel electrode PE2 (see, FIG. 2) in response to the second gate signal.

In the meantime, the common voltage is applied to the common electrode 134 (see, FIG. 3). Accordingly, the first liquid crystal capacitor $C_{LC1}$ is charged with a voltage corresponding to the potential difference between the high gamma voltage $V_H$ and the common voltage and the second liquid crystal capacitor $C_{LC2}$ is charged with a voltage corresponding to the potential difference between the low gamma voltage $V_L$ and the common voltage.

In FIG. 5, a first line G1 represents an exemplary embodiment of the transmittance as a function of the gray scale in the main pixel, a second line G2 represents the transmittance as a function of the gray scale in the sub pixel and a third line G3 represents the overlap state of the first and second lines G1 and G2.

As shown in FIGS. 4 and 5, when the high and low gamma voltages $V_H$ and $V_L$ are applied to the main and sub pixels, respectively, the transmittance may vary depending on the gray scales. That is, the transmittance of the main pixel is higher than that of the sub pixel under the same gray scale. At this time, a person seeing the liquid crystal display panel may recognize an intermediate value between the high and low gamma voltages $V_H$ and $V_L$, such that degradation of a side viewing angle caused by distortion of a gamma curve at the gray scale level below the intermediate gray scale level can be reduced or effectively prevented.

Figure 6:
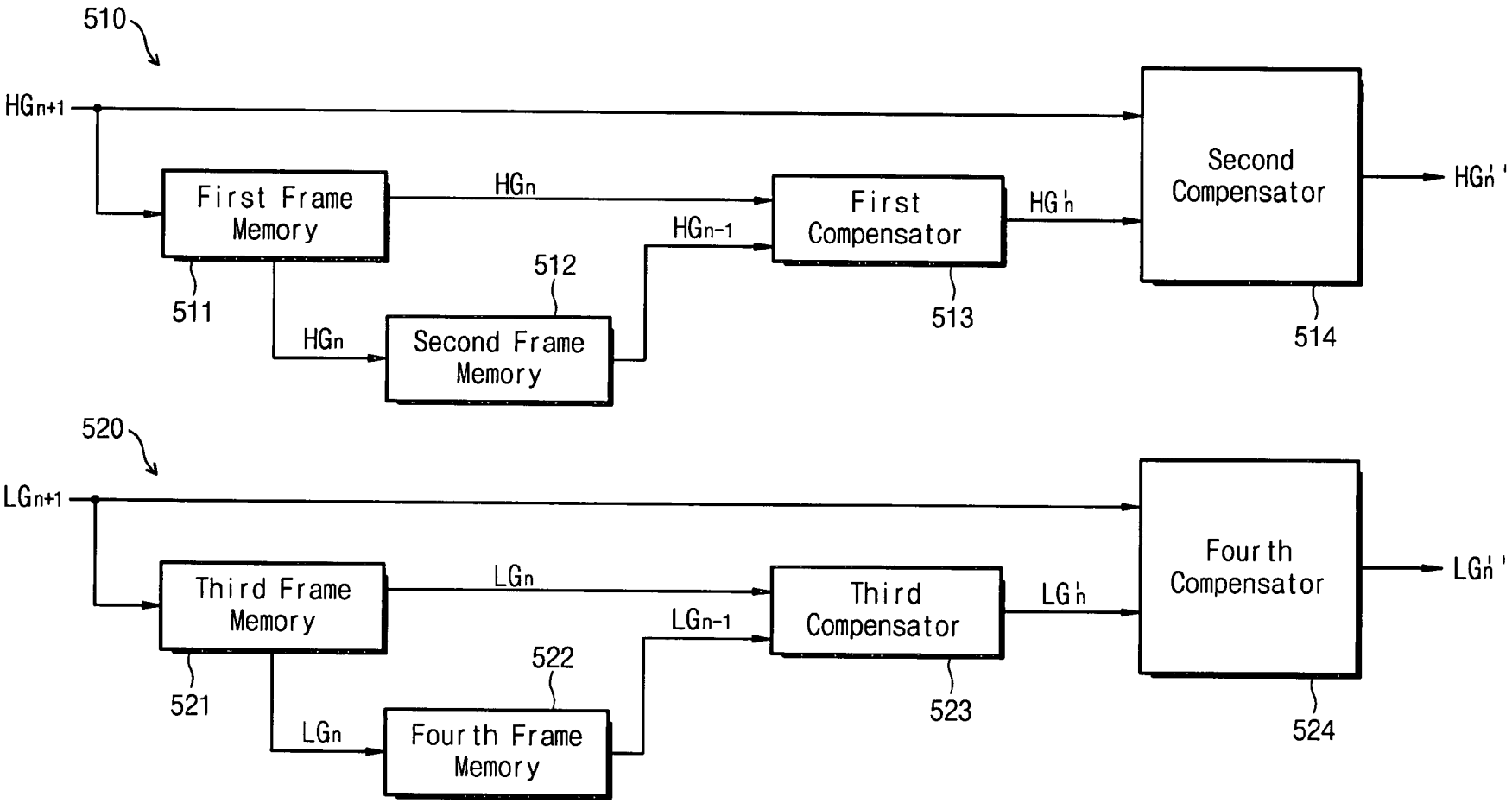
FIG. 6 is a block diagram showing an exemplary embodiment of an internal structure of first and second image processors shown in FIG. 1.

FIG. 6 is a block diagram showing an exemplary embodiment of the internal structure of first and second image processors shown in FIG. 1.

Referring to FIG. 6, the first image processor 510 includes a first frame memory 511, a second frame memory 512, a first compensator 513 and a second compensator 514. In addition, the second image processor 520 includes a third frame memory 521, a fourth frame memory 522, a third compensator 523 and a fourth compensator 524.

The first frame memory 511 receives and stores a first high image signal HGn+1 of a next frame (that is, a $(n+1)^{th}$ frame), and outputs a second high image signal HGn of a current frame (that is, an $n^{th}$ frame that has been previously stored). The second frame memory 512 outputs a third high image signal HGn−1 of a previous frame (that is, a $(n-1)^{th}$ frame that has been previously stored), and stores the second high image signal HGn. Thus, high image signals are continuously stored in the first and second frame memories 511 and 512 in frame units.

The first compensator 513 generates a first high compensated signal HGn' based on the second and third high image signals HGn and HGn−1 and the second compensator 514 generates a second high compensated signal HGn" based on the first high image signal HGn+1 and the first high compensated signal HGn'.

In detail, if a difference value between the second high image signal HGn and the third high image signal HGn−1 is greater than a predetermined first reference value, the first compensator 513 generates the first high compensated signal HGn' by adding a predetermined first compensation value α to the second high image signal HGn. However, if the difference value between the second high image signal HGn and the third high image signal HGn−1 is equal to or less than the predetermined first reference value, the first compensator 513 outputs the second high image signal HGn as the first high compensated signal HGn'.

Then, the first high compensated signal HGn' is provided to the second compensator 514. If the first high image signal HGn+1 is greater than a predetermined second reference value and the first high compensated signal HGn' is less than a predetermined third reference value, the second compensator 514 generates the second high compensated signal HGn" by adding a second compensation value β to the first high compensated signal HGn'. Here, the second high compensated signal HGn", which is obtained by adding the second compensation value β to the first high compensated signal HGn', is called a "high pretilt gray scale".

In contrast, if the first high image signal HGn+1 is equal to or less than the predetermined second reference value or the first high compensated signal HGn' is equal to or greater than the predetermined third reference value, the second compensator 514 outputs the first high compensated signal HGn' as the second high compensated signal HGn".

In the second image processor 520, the third frame memory 521 receives and stores a first low image signal LGn+1 of the next frame and outputs a second low image signal LGn of the current frame which has been previously stored. In addition, the fourth frame memory 522 outputs a third low image signal LGn−1 of the previous frame that has been previously stored and stores the second low image signal LGn. Thus, low image signals are continuously stored in the third and fourth frame memories 521 and 522 in frame units.

The third compensator 523 generates a first low compensated signal LGn' based on the second and third low image signals LGn and LGn−1, and the fourth compensator 524 generates a second low compensated signal LGn" based on the first low image signal LGn+1 and the first low compensated signal LGn'.

In detail, if a difference value between the second low image signal LGn and the third low image signal LGn−1 is greater than a predetermined fourth reference value, the third compensator 523 generates the first low compensated signal LGn' by adding a predetermined third compensation value γ to the second low image signal LGn. However, if the difference value between the second low image signal LGn and the third low image signal LGn−1 is equal to or less than the predetermined fourth reference value, the third compensator 523 outputs the second low image signal LGn as the first low compensated signal LGn'.

Then, the first low compensated signal LGn' is provided to the fourth compensator 524. If the first low image signal LGn+1 is greater than a predetermined fifth reference value and the first low compensated signal LGn' is less than a predetermined sixth reference value, the fourth compensator 524 generates the second low compensated signal LGn" by adding a fourth compensation value δ to the first low compensated signal LGn'. In contrast, if the first low image signal LGn+1 is equal to or less than the predetermined fifth reference value, or the first low compensated signal LGn' is equal to or greater than the predetermined sixth reference value, the fourth compensator 524 outputs the first low compensated signal LGn' as the second low compensated signal LGn".

Here, the second low compensated signal LGn", which is obtained by adding the fourth compensation value δ to the first low compensated signal LGn', is called a "low pretilt gray scale". As shown in the illustrated embodiment of FIG. 5, the low pretilt gray scale a1 is higher than the high pretilt gray scale a2. Accordingly, a low pretilt voltage P1 corresponding to the low pretilt gray scale a1 is applied to the sub pixel. In addition, a high pretilt voltage P1, which corresponds to the high pretilt gray scale a2 and has a level identical to that of the low pretilt voltage P1, is applied to the main pixel.

That is, since the same pretilt voltage is applied to the main and sub pixels, an amount of charge applied to liquid crystal in the first period, during which the main pixels are driven, is identical to an amount of charge applied to the liquid crystal in the second period, during which the sub pixels are driven.

Figure 7:
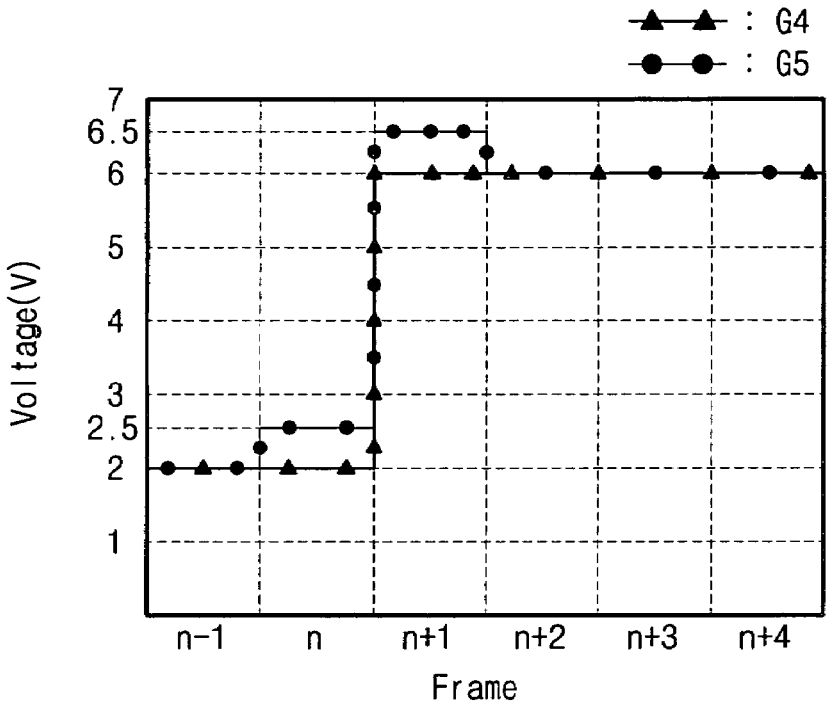
FIG. 7 is a graph showing an exemplary embodiment of input/output signals of the first image processor shown in FIG. 6.
Figure 8:
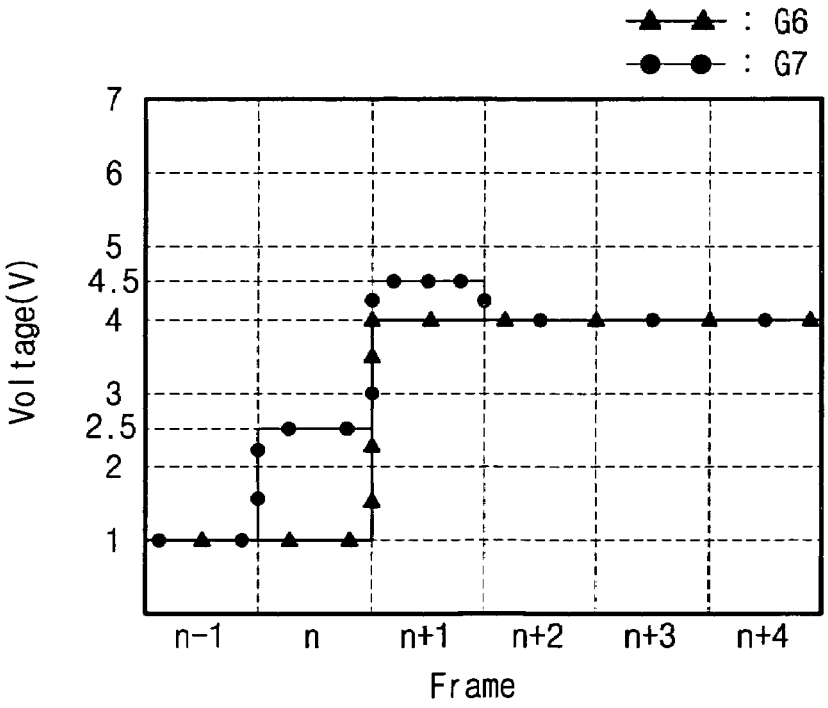
FIG. 8 is a graph showing an exemplary embodiment of input/output signals of the second image processor shown in FIG. 6.

FIG. 7 is a graph showing an exemplary embodiment of input/output signals of the first image processor 510 shown in FIG. 6 and FIG. 8 is a graph showing an exemplary embodiment of input/output signals of the second image processor 520 shown in FIG. 6. In FIGS. 7 and 8, the x-axis represents a frame and the y-axis represents a voltage (V).

A fourth line G4 (e.g.--▲--) shown in FIG. 7 represents an input signal transmitted to the first image processor 510 (see, FIG. 6), and a fifth line G5 (e.g., --●--) represents an output signal which has been compensated by the first image processor 510. In addition, a sixth line G6 (e.g.--▲--) shown in FIG. 8 represents an input signal transmitted to the second image processor 520 (see, FIG. 6), and a seventh line G7 (e.g., --●--) represents an output signal which has been compensated by the second image processor 520.

As can be understood from the fourth line G4 shown in FIG. 7, the input signal transmitted to the first image processor 510 is maintained at 2V in the $(n-1)^{th}$ frame and the $n^{th}$ frame, but is maintained at 6V in the $(n+1)^{th}$ frame to the $(n+4)^{th}$ frame. Here, the voltage (V) is expressed with an absolute value.

Referring to the fifth line G5, since the second high image signal of the $n^{th}$ frame and the third high image signal of the $(n-1)^{th}$ frame have the same voltage level of 2V, the first compensator 513 (see, FIG. 6) outputs the first high compensated signal identical to the second high image signal. Then, the second compensator 514 (see, FIG. 6) compares the first high image signal of the $(n+1)^{th}$ frame with the first high compensated signal. Since the first high image signal is greater than the predetermined second reference value (for example, 5V), and the first high compensated signal is less than the predetermined third reference value (for example, 3V), the second compensator 514 generates the second high compensated signal of 2.5V by adding the predetermined second compensation value β (for example, 0.5V) to the first high compensated signal. Here, the second high compensated signal is a high pretilt voltage applied to the main pixel in the $n^{th}$ frame.

Next, since the voltage difference between the first high image signal of the $(n+1)^{th}$ frame and the second high image signal of the $n^{th}$ frame is 4V, which is greater than the predetermined first reference value (for example, 3V), the first compensator 513 outputs the first high compensated signal of 6.5V, which is overshot from the first high image signal by the predetermined first compensation value α (for example, 0.5V). After that, the second compensator 514 compares the fourth high image signal of the $(n+2)^{th}$ frame with the first high compensated signal. Since the fourth high image signal is greater than the predetermined second reference value (for example, 5V), and the first high compensated signal is greater than the predetermined third reference value (for example, 3V), the second compensator 514 generates the second high compensated signal identical to the first high compensated signal.

As can be understood from the sixth line G6 shown in FIG. 8, the input signal transmitted to the second image processor 520 is maintained at 1V in the $(n-1)^{th}$ frame and the $n^{th}$ frame, but maintained at 4V in the $(n+1)^{th}$ frame to the $(n+4)^{th}$ frame. Here, the voltage (V) is also expressed with an absolute value.

Referring to the seventh line G7, since the second low image signal of the $n^{th}$ frame and the third low image signal of the $(n-1)^{th}$ frame have the same voltage level of 1V, the third compensator 523 (see, FIG. 6) outputs the first low compensated signal identical to the second low image signal. Then, the fourth compensator 524 (see, FIG. 6) compares the first low image signal of the $(n+1)^{th}$ frame with the first low compensated signal. Since the first low image signal is greater than the predetermined fifth reference value (for example, 3.5V), and the first low compensated signal is less than the predetermined sixth reference value (for example, 2V), the fourth compensator 524 generates the second low compensated signal of 2.5V by adding the predetermined fourth compensation value δ (for example, 1.5V) to the first low compensated signal. Here, the second low compensated signal is a low pretilt voltage applied to the sub pixel in the $n^{th}$ frame.

Next, since the voltage difference between the first low image signal of the $(n+1)^{th}$ frame and the second low image signal of the $n^{th}$ frame is 3V, which is greater than the predetermined fourth reference value (for example, 2.5V), the third compensator 523 outputs the first low compensated signal of 4.5V, which is overshot from the first low image signal by the predetermined third compensation value γ (for example, 0.5V). After that, the fourth compensator 524 compares the fourth low image signal of the $(n+2)^{th}$ frame with the first low compensated signal. Since the fourth low image signal is greater than the predetermined fifth reference value (for example, 3.5V), and the first low compensated signal is greater than the predetermined sixth reference value (for example, 2V), the fourth compensator 524 generates the second low compensated signal identical to the first low compensated signal.

As shown in FIGS. 7 and 8, the level of the high pretilt voltage applied to the main pixel becomes equal to the level of the low pretilt voltage applied to the sub pixel in the $n^{th}$ frame because the fourth compensation value δ has the voltage level greater than that of the second compensation value β by 1V. Accordingly, the amount of charge applied to liquid crystal in the first period, during which the main pixels are driven, is identical to the amount of charge applied to the liquid crystal in the second period, during which the sub pixels are driven. As a result, the liquid crystal is charged with the same voltage during the first and second periods, so that the response speed of the liquid crystal may not be lowered.

Figure 9:
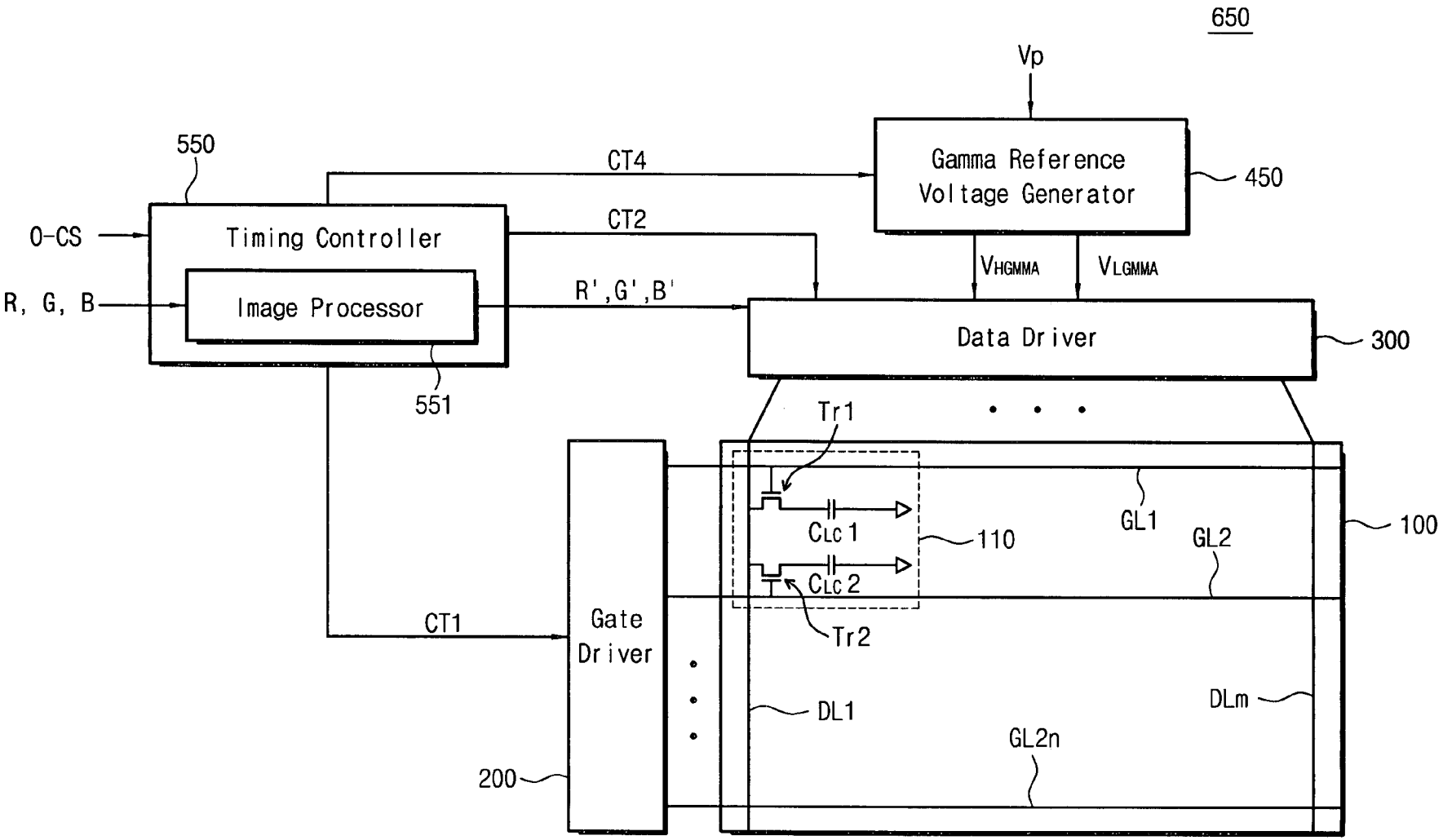
FIG. 9 is a block diagram showing another exemplary embodiment of a liquid crystal display device according to the present invention.

FIG. 9 is a block diagram showing another exemplary embodiment of a liquid crystal display device according to the present invention. Here, the same reference numerals denote the same elements shown in FIG. 1 and thus the detailed description thereof will be omitted in order to avoid redundancy.

Referring to FIG. 9, a liquid crystal display device 650 includes a display unit 100, a gate driver 200, a data driver 300, a gamma reference voltage generator 450 and a timing controller 550.

A plurality of pixel areas are defined in the display unit 100 by a plurality of gate lines GL1 to GL2*n* and a plurality of data lines DL1 to DLm. Pixels 110 each including a main pixel and a sub pixel are provided in the pixel areas, respectively.

The gate driver 200 is electrically connected to the gate lines GL1 to GL2*n* provided in the display unit 100 so as to apply gate signals to the gate lines GL1 to GL2*n*. The data driver 300 is electrically connected to the data lines DL1 to DLm provided in the display unit 100 in order to apply the high or low gamma voltage to the data lines DL1 to DLm.

The timing controller 550 receives external image signals R, G and B and various control signals O-CS from an external graphic controller (not shown). The timing controller 550 includes an image processor 551, which compensates the external image signals R, G and B to output compensated signals R', G' and B'.

In addition, the timing controller 550 receives various control signals O-CS including, but not limited to, a vertical synchronous signal, a horizontal synchronous signal, a main clock signal, a data enable signal, etc., in order to output first, second and fourth control signals CT1, CT2 and CT4, respectively.

The first control signal CT1 is transmitted to the gate driver 200 so as to control the operation of the gate driver 200. The gate driver 200 sequentially outputs the gate signals to the gate lines GL1 to GL2*n* in response to the first control signal CT1 from the timing controller 550.

The second control signal CT2 is transmitted to the data driver 300 so as to control the operation of the data driver 300. The data driver 300 sequentially receives the compensated signals R', G' and B', which correspond to pixels of one row, in response to the second control signal CT2 from the timing controller 550.

The gamma reference voltage generator 450 receives the power supply voltage Vp from an exterior and then generates high and low gamma reference voltages $V_{HGMMA}$ and $V_{LGMMA}$ in response to the fourth control signal CT4 from the timing controller 550. In detail, the gamma reference voltage generator 450 generates the high gamma reference voltage $V_{HGMMA}$ in response to the fourth control signal CT4 in the first period during which the main pixel is driven, and generates the low gamma reference voltage $V_{LGMMA}$ in response to the fourth control signal CT4 in the second period during which the sub pixel is driven.

The image processor 551 outputs the compensated signals R', G' and B' in the first and second periods during which the main and sub pixels are driven, respectively. The data driver 300 converts the compensated signals R', G' and B' into high gamma voltages based on the high gamma reference voltage $V_{HGMMA}$ in order to output the high gamma voltages during the first period, and converts the compensated signals R', G' and B' into low gamma voltages in order to output the low gamma voltages during the second period. Here, the high gamma voltage has a level higher than that of the low gamma voltage.

The image processor 551 outputs the high pretilt gray scale during the pretilt period of the main pixel and outputs the low pretilt gray scale during the pretilt period of the sub pixel.

Referring again to FIG. 5, the high pretilt gray scale a2 is lower than the low pretilt gray scale a1. Thus, the data driver 300 outputs the high pretilt voltage corresponding to the high pretilt gray scale a2 based on the high gamma reference voltage $V_{HGMMA}$ and outputs the low pretilt voltage corresponding to the low pretilt gray scale a1 based on the low gamma reference voltage $V_{LGMMA}$. In this case, the high pretilt voltage has a level identical to that of the low pretilt voltage.

Advantageously, the liquid crystal can be charged with the same voltage in the first and second periods during which the main and sub pixels are driven, respectively, so that the response speed of the liquid crystal may not be lowered.

As in the illustrated exemplary embodiments of the display device, high and low pretilt voltages having the same level are applied to the liquid crystal in the first and second periods during which the main and sub pixels are pretilted, respectively.

In an exemplary embodiment, the liquid crystal can be charged with the same voltage during the first and second periods, so that the response speed of the liquid crystal may not be lowered. Advantageously, quality of images displayed on the display device can be improved.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A display device comprising:

a first image processor which outputs a first pretilt signal in response to a first external image signal during a first pretilt period, the first pretilt signal corresponding to a first gray scale;

a second image processor which outputs a second pretilt signal in response to a second external image signal during a second pretilt period, the second pretilt signal corresponding to a second gray scale higher than the first gray scale;

a gamma reference voltage generator receiving which receives a power supply voltage from an exterior and outputs a gamma reference voltage;

a data driver which converts the first pretilt signal into a first voltage based on the gamma reference voltage and outputs the first voltage during the first pretilt period, and which converts the second pretilt signal into a second voltage based on the gamma reference voltage and outputting outputs the second voltage during the second pretilt period, the second voltage being identical to the first voltage;

a gate driver which outputs a first gate signal during the first pretilt period and a second gate signal during the second pretilt period; and a display unit which displays images using a plurality of pixels including first pixels receiving which receive the first voltage in response to the first gate signal during the first pretilt period and second pixels which receive the second voltage in response to the second gate signal during the second pretilt period.

2. The display device of claim 1, wherein the first image processor receives a first high image signal of a next frame, generates a first high compensated signal based on a second high image signal of a current frame that has been previously stored and a third high image signal of a previous frame that has been previously stored and generates a second high compensated signal based on the first high image signal and the first high compensated signal, and wherein the second image processor receives a first low image signal of the next frame, generates a first low compensated signal based on a second low image signal of the current frame that has been previously stored and a third low image signal of the previous frame that has been previously stored and generates a second low compensated signal based on the first low image signal and the first low compensated signal.

3. The display device of claim 2, wherein the first image processor generates the first high compensated signal identical to the third high image signal and the second high compensated signal by adding a first high compensation value to the first high compensated signal under conditions including that the third high image signal is less than a predetermined first reference value, the first high compensated value is less than a predetermined second reference value, and the first high image signal is greater than a predetermined third reference value, and wherein the second image processor generates the first low compensated signal identical to the third low image signal and the second low compensated signal by adding a first low compensation value to the first low compensated signal under conditions including that the third low image signal is less than a predetermined fourth reference value, the first low compensated value is less than a predetermined fifth reference value, and the first low image signal is greater than a predetermined sixth reference value.

4. The display device of claim 3, wherein the first and second pretilt periods are included in the current frame, the first image processor outputs the second high compensated signal as the first pretilt signal, and the second image processor outputs the second low compensated signal as the second pretilt signal.

5. The display device of claim 4, wherein the first high compensation value is smaller than the first low compensation value.

6. The display device of claim 2, wherein the first image processor generates the first high compensated signal instead of the first pretilt signal during the next frame, the first high compensated signal being an overshot from the second high compensated signal by a second high compensation value, the second high compensated signal having a value identical to that of the first high compensated signal under conditions including that the third high image signal is equal to or greater than a predetermined first reference value, the first high compensated value is equal to or greater than a predetermined second reference value, or the first high image signal is equal to or less than a predetermined third reference value, and wherein the second image processor generates the first low compensated signal instead of the second pretilt signal during the next frame, the first low compensated signal being an overshot from the second low compensated signal by a second low compensation value, the second low compensated signal having a value identical to that of the first low compensated signal under conditions including that the third low image signal is equal to or greater than a predetermined fourth reference value, the first low compensated value is equal to or greater than a predetermined fifth reference value, or the first low image signal is equal to or less than a predetermined sixth reference value.

7. The display device of claim 6, wherein the data driver converts the second high compensated signal of the first image processor into a high gamma voltage based on the gamma reference voltage, outputs the high gamma voltage during the next frame, converts the second low compensated signal of the second image processor into a low gamma voltage having a level lower than that of the high gamma voltage based on the gamma reference voltage and outputs the low gamma voltage during the next frame.

8. The display device of claim 1, wherein the first image processor comprises:

a first frame memory receiving and storing a first high image signal of a next frame and outputting a second high image signal of a current frame that has been previously stored;

a second frame memory outputting a third high image signal of a previous frame that has been previously stored and receiving the second high image signal of the current frame;

a first compensator generating a first high compensated signal based on the second and third high image signals; and a second compensator generating a second high compensated signal corresponding to the first pretilt signal, based on the first high image signal and the first high compensated signal.

9. The display device of claim 8, wherein the second image processor comprises:

a third frame memory receiving and storing a first low image signal of a next frame and outputting a second low image signal of a current frame that has been previously stored;

a fourth frame memory outputting a third low image signal of a previous frame that has been previously stored and receiving the second low image signal of the current frame;

a third compensator generating a first low compensated signal based on the second and third low image signals; and a fourth compensator generating a second low compensated signal corresponding to the second pretilt signal, based on the first low image signal and the first low compensated signal.

10. The display device of claim 1, wherein the display unit further comprises:

a first gate line receiving the first gate signal for an earlier H/2 period during which main pixels are driven, the pixels being driven for 1H period;

a second gate line receiving the second gate signal for a later H/2 period during which sub pixels are driven, the pixels being driven for 1H period; and a data line receiving the first voltage during the earlier H/2 period and receiving the second voltage during the later H/2 period.

11. The display device of claim 10, wherein the first pixels comprise:

a first switching device electrically connected to the first gate line and the data line and outputting the first voltage in response to the first gate signal; and a first liquid crystal capacitor charged with the first voltage; and the second pixels comprise:

a second switching device electrically connected to the second gate line and the data line and outputting the second voltage in response to the second gate signal; and a second liquid crystal capacitor charged with the second voltage.

12. The display device of claim 1, further comprising:

a timing controller receiving control signals from an exterior and providing first, second and third control signals to the gate driver, the data driver and the gamma reference voltage generator, respectively.

13. The display device of claim 12, wherein the timing controller includes the first and second image processors.

14. A display device comprising:

an image processor which outputs a first pretilt signal during a first pretilt period and a second pretilt signal during a second pretilt period in response to external image signals, the first pretilt signal corresponding to a first gray scale and the second pretilt signal corresponding to a second gray scale higher than the first gray scale;

a gamma reference voltage generator receiving which receives a power supply voltage from an exterior and outputs a first and second gamma reference voltages;

a data driver which converts the first pretilt signal into a first voltage based on the first gamma reference voltage and outputs the first voltage during the first pretilt period, and converts the second pretilt signal into a second voltage based on the second gamma reference voltage and outputting outputs the second voltage during the second pretilt period, the second voltage being identical to the first voltage;

a gate driver which outputs a first gate signal during the first pretilt period and outputting outputs a second gate signal during the second pretilt period; and a display unit which displays images using a plurality of pixels including first pixels which receive the first voltage in response to the first gate signal during the first pretilt period and second pixels which receive the second voltage in response to the second gate signal during the second pretilt period.

15. The display device of claim 14, wherein the image processor comprises:

a first frame memory which receives and stores the first image signal of a next frame and outputs a second image signal of a current frame which has been previously stored;

a second frame memory which outputs a third image signal of a previous frame which has been previously stored and receives the second image signal of the current frame;

a first compensator which generates a first compensated signal based on the second and third image signals; and a second compensator which generates a second compensated signal corresponding to the first pretilt signal, or a third compensated signal corresponding to the second pretilt signal based on the first image signal and the first compensated signal.

16. The display device of claim 14, wherein the display unit further comprises:

a first gate line receiving the first gate signal for a earlier H/2 period during which main pixels are driven, the pixels being driven for 1H period;

a second gate line receiving the second gate signal for a later H/2 period during which sub pixels are driven, the pixels being driven for 1H period; and a data line receiving the first voltage during the first H/2 period and receiving the second voltage during the second H/2 period.

17. The display device of claim 16, wherein the first pixel comprises:

a first switching device electrically connected to the first gate line and the data line and which outputs the first voltage in response to the first gate signal; and a first liquid crystal capacitor which is charged with the first voltage; and the second pixel comprises:

a second switching device electrically connected to the second gate line and the data line and which outputs the second voltage in response to the second gate signal; and a second liquid crystal capacitor which is charged with the second voltage.

18. A method of driving a display device, the method comprising:

outputting a first pretilt signal in response to a first external image signal during a first pretilt period, the first pretilt signal corresponding to a first gray scale, wherein a first image processor outputs the first pretilt signal;

outputting a second pretilt signal in response to a second external image signal during a second pretilt period, the second pretilt signal corresponding to a second gray scale higher than the first gray scale, wherein a second image processor outputs the second pretilt signal;

receiving a power supply voltage from an exterior and outputting a gamma reference voltage, wherein a gamma reference voltage generator receives the power supply voltage and outputs the gamma reference voltage;

converting the first pretilt signal into a first voltage based on the gamma reference voltage and outputting the first voltage during the first pretilt period, and converting the second pretilt signal into a second voltage based on the gamma reference voltage and outputting the second voltage during the second pretilt period, the second voltage being identical to the first voltage, wherein a data driver converts the first and second pretilt signals and outputs the first and second voltages;

outputting a first gate signal during the first pretilt period and outputting a second gate signal during the second pretilt period, wherein a gate driver outputs the first and second gate signals; and displaying images using a plurality of pixels including first pixels receiving the first voltage in response to the first gate signal during the first pretilt period and second pixels receiving the second voltage in response to the second gate signal during the second pretilt period, wherein a display unit displays the images.

19. A display device comprising:

a first image processor which outputs a first pretilt signal in response to a first external image signal during a first pretilt period, the first pretilt signal corresponding to a first gray scale;

a second image processor which outputs a second pretilt signal in response to a second external image signal during a second pretilt period, the second pretilt signal corresponding to a second gray scale higher than the first gray scale;

a gamma reference voltage generator which receives a power supply voltage from an exterior and outputs a gamma reference voltage;

a data driver which converts the first pretilt signal into a first voltage based on the gamma reference voltage and outputs the first voltage during the first pretilt period, and which converts the second pretilt signal into a second voltage based on the gamma reference voltage and outputs the second voltage during the second pretilt period;

a gate driver which outputs a first gate signal during the first pretilt period and a second gate signal during the second pretilt period; and a display unit which displays images using a plurality of pixels, each pixel of which includes a main pixel which receives the first voltage in response to the first gate signal during the first pretilt period and a sub pixel which receives the second voltage in response to the second gate signal during the second pretilt period, wherein a first transmittance of the main pixel during the first pretilt period is identical to a second transmittance of the sub pixel during the second pretilt period.

20. A display device comprising:

an image processor which outputs a first pretilt signal during a first pretilt period and a second pretilt signal during a second pretilt period in response to external image signals, the first pretilt signal corresponding to a first gray scale and the second pretilt signal corresponding to a second gray scale higher than the first gray scale;

a gamma reference voltage generator which receives a power supply voltage from an exterior and outputs a first gamma reference voltage and a second gamma reference voltage having a level lower than the first gamma reference voltage;

a data driver which converts the first pretilt signal into a first voltage based on the first gamma reference voltage and outputs the first voltage during the first pretilt period, and which converts the second pretilt signal into a second voltage based on the second gamma reference voltage and outputs the second voltage during the second pretilt period;

a gate driver which outputs a first gate signal during the first pretilt period and a second gate signal during the second pretilt period; and a display unit which displays images using a plurality of pixels, each pixel of which includes a main pixel which receives the first voltage in response to the first gate signal during the first pretilt period and a sub pixel which receives the second voltage in response to the second gate signal during the second pretilt period, wherein a first transmittance of the main pixel during the first pretilt period is identical to a second transmittance of the sub pixel during the second pretilt period.

* * * * *